US008079472B2

(12) United States Patent
Gillain

(10) Patent No.: US 8,079,472 B2
(45) Date of Patent: Dec. 20, 2011

(54) DEPLOYABLE CONTAINER FOR BOTTLES OR THE LIKE

(75) Inventor: Zohra Gillain, Paris (FR)

(73) Assignee: Zebag, Paris (FR)

( * ) Notice: Subject to any disclaimer, the term of this patent is extended or adjusted under 35 U.S.C. 154(b) by 23 days.

(21) Appl. No.: 12/525,001

(22) PCT Filed: Jan. 30, 2008

(86) PCT No.: PCT/FR2008/000107

§ 371 (c)(1),
(2), (4) Date: Jul. 29, 2009

(87) PCT Pub. No.: WO2008/107565

PCT Pub. Date: Sep. 12, 2008

(65) Prior Publication Data

US 2010/0032328 A1 Feb. 11, 2010

(30) Foreign Application Priority Data

Jan. 30, 2007 (FR) ..... 07 00635

(51) Int. Cl.
*B65D 75/00* (2006.01)
*B65D 81/02* (2006.01)

(52) U.S. Cl. ..... 206/433; 206/521; 206/593; 229/87.02; 229/91

(58) Field of Classification Search ..... 206/427, 206/433, 434, 587, 591–594, 521; 229/89–91, 229/87.02, 406
See application file for complete search history.

(56) References Cited

U.S. PATENT DOCUMENTS

| | | | | |
|---|---|---|---|---|
| 3,587,838 | A * | 6/1971 | Miyata | 206/592 |
| 3,659,705 | A * | 5/1972 | Falkin | 206/784 |
| 4,471,573 | A * | 9/1984 | Voges | 206/423 |
| 5,806,683 | A * | 9/1998 | Gale | 206/587 |

FOREIGN PATENT DOCUMENTS

| | | |
|---|---|---|
| FR | 2 725 423 | 4/1996 |
| WO | WO 2005/021390 | 3/2005 |

* cited by examiner

*Primary Examiner* — Luan K Bui
(74) *Attorney, Agent, or Firm* — Muncy, Geissler, Olds & Lowe, PLLC

(57) ABSTRACT

The invention relates to a container for bottles or the like. In accordance with the invention, it comprises a plurality of hollow cells each adapted to receive one bottle and presenting two converging external side faces and one bottom face with which the side faces define side edges, the cells being interconnected so that two adjacent cells are hinged together via the side edges such that the container presents a folded state in which the side faces of the cells bear one against another so as to give the container the shape of a cylinder on a polygonal base and a deployed state in which the bottom walls of the cells extend flat and the cells extend beside one another, with each of them remaining suitable for receiving one bottle.

8 Claims, 6 Drawing Sheets

DEPLOYABLE CONTAINER FOR BOTTLES OR THE LIKE

The invention relates to a deployable container for bottles or the like.

BACKGROUND OF THE INVENTION

Bottle-rack type containers are known that are suitable for receiving bottles vertically. Such containers are often designed to be stackable to facilitate transporting and storing bottles. For example, document FR 2 725 423 discloses a bottle-rack having compartments or cells, each suitable for receiving one bottle. Those cells are generally of triangular section, each with a missing apex. Nevertheless, that rack is obtained by folding a side that gives rise to a shape that is generally cylindrical. If an attempt is made to deploy the side, the cells are no longer formed and are thus no longer suitable for receiving respective bottles.

OBJECT OF THE INVENTION

An object of the invention is to provide a container of a novel type that enables bottles or the like to be transported and that is capable of being deployed, e.g. to form a bottle display.

BRIEF SUMMARY OF THE INVENTION

According to the invention, there is provided a container for bottles or the like comprising a plurality of hollow cells, each adapted to receive one bottle and presenting two converging external side faces and one bottom face with which the side faces define side edges, the cells being interconnected so that two adjacent cells are hinged together via the side edges, the container presenting:

- a folded state in which the side faces of the cells bear one against another so as to give the container the shape of a cylinder on a polygonal base; and
- a deployed state in which the bottom walls of the cells extend flat and the cells extend beside one another, with each of them remaining suitable for receiving one bottle.

Thus, the bottom faces of each of the cells run on continuously one from another, each cell forming a receptacle for one bottle. The container can thus be placed in a folded state in which the side faces of the cells bear against one another so as to form a cylindrical container that is easy to transport, and a deployed state in which the cells extend one beside another, so as to form a bottle display.

BRIEF DESCRIPTION OF THE DRAWINGS

The invention can be better understood in the light of the following description with reference to the figures of the accompanying drawings, in which.

DETAILED DESCRIPTION OF THE INVENTION

Figure 1:
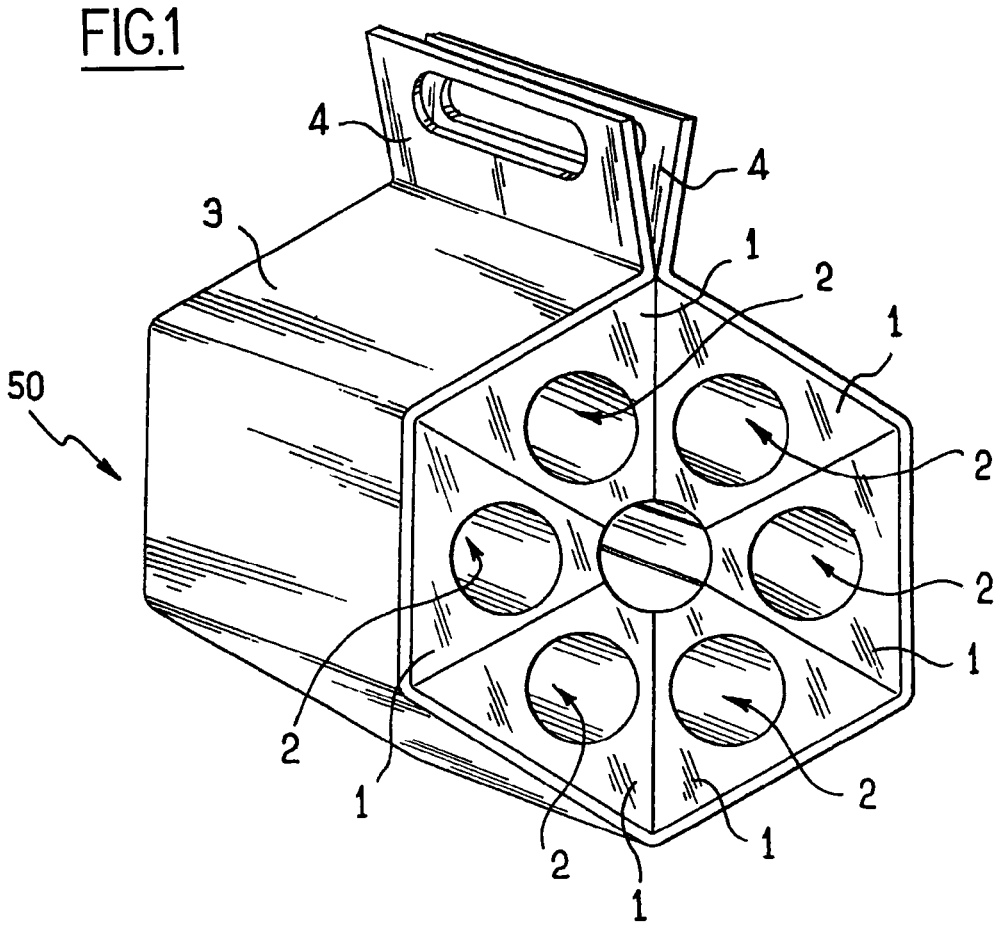
FIG. 1 is a perspective view of a container in a first particular embodiment of the invention, having six cells and shown in the folded state.

With reference to FIG. 1, and in accordance with a first particular embodiment of the invention, the container 50 here comprises six cells, taking the form of cylindrical elements 1.

Figure 5:
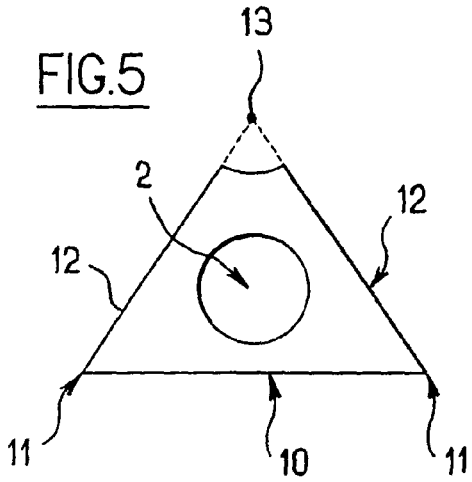
FIG. 5 is a face view of one of the cells of the FIG. 1 container.

The term "cylindrical" is used in accordance with the conventional geometrical definition to mean an article having its outside surface generated by a bundle of parallel generator lines extending from a given directrix curve. In this example, and as can be seen in FIG. 5, the cylindrical elements 1 present a right section defined by a directrix curve that is generally in the shape of an equilateral triangle. The generator lines define on each cylindrical element 1 a bottom face 10 defined by two side edges 11 extending at the intersections between the bottom face 10 and two side faces 12 converging on an apex 13. Each cylindrical element 1 presents an open orifice 2, e.g. for receiving a bottle. The apex 13 at the intersection between the two side faces 12 is broken and shaped into a circular arcuate shape having a diameter that is substantially equal to the diameter of the open orifice 2.

Returning to FIG. 1, the bottom faces 10 of the cylindrical elements 1 are adhesively bonded to a belt 3 so as to be adjacent one another. The belt 3 forms hinge means between pairs of adjacent cylindrical elements 1 enabling two adjacent cylindrical elements 1 to pivot relative to each other about a pivot axis that is parallel to the side edges 11 of the cylindrical elements 1. The belt 3, here made of stiff cardboard, has free ends that have cut outs to form handles 4.

In the folded state shown in this figure, the side faces 12 of two adjacent cylindrical elements 1 bear one against another so that the cylindrical elements 1 together form a cylinder of hexagonal base, the belt 3 surrounding the assembly so that the two handles 4 are superposed. The container 50 can thus be lifted using the handles 4 and transported easily. It should be observed that the rounded apexes 13 together form an open orifice suitable for receiving an additional bottle, such that, in the folded state, the container can be used to transport seven bottles. It should be observed that the bottles in this example are transported while horizontal. The container 50 as folded in this way may be stacked with other containers of the same type to form a bottle storage space having hexagonal cells in a honeycomb configuration, thereby optimizing the filling of the storage space created in this way.

Figure 2:
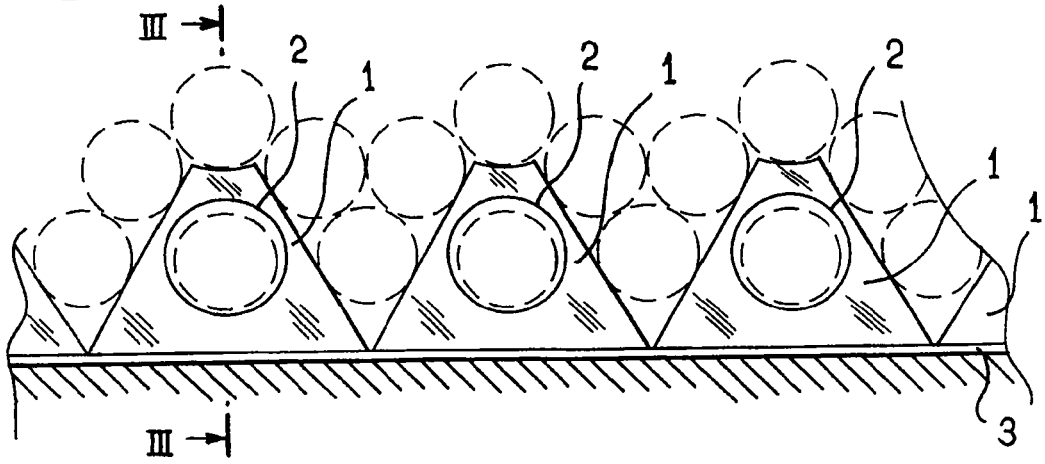
FIG. 2 is a fragmentary face view of the FIG. 1 container, shown in the deployed state and placed on a shelf or a table.
Figure 4:
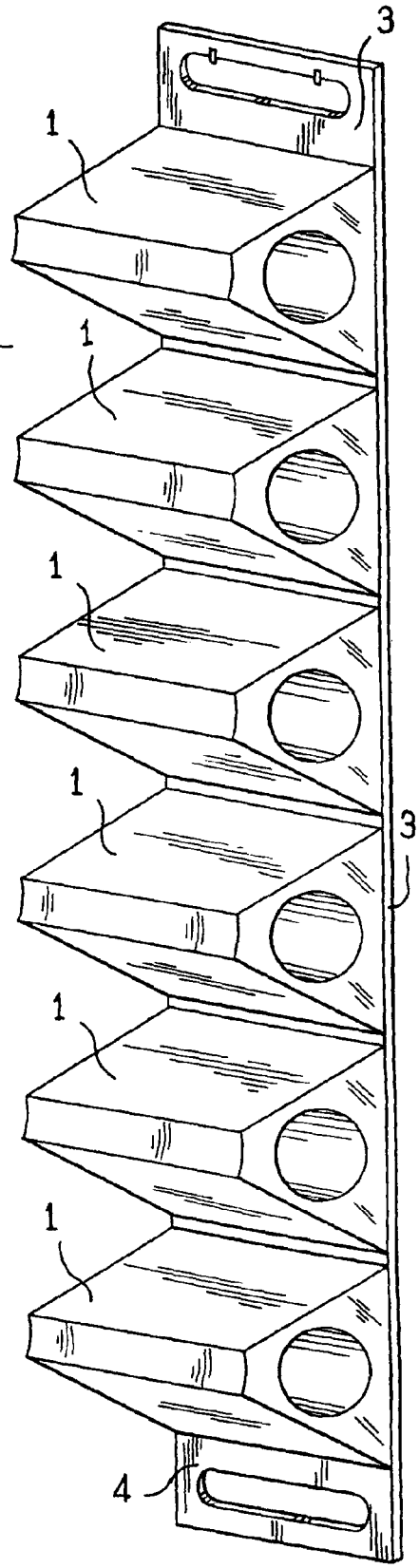
FIG. 4 is a perspective view of the FIG. 1 container, shown in the deployed state, and suspended from hooks.

As can be seen in FIG. 2, the container 50 may also be placed in a deployed state where the belt 3 extends flat. The belt 3 is shown placed on a plane support, e.g. a shelf. The cylindrical elements 1 extend one beside another so that the container placed in this way forms a display for receiving bottles (shown in dashed lines), either in the receiver orifices 2, or in the recesses that extend between two adjacent cylindrical elements 1, or else placed on the rounded apexes 13 of the cylindrical elements 1. In a variant utilization shown in FIG. 4, the container in the deployed position may be suspended from a wall by means of hooks, so as to form a wall-mounted bottle-rack enabling six bottles to be stored in the open orifices 2.

Figure 3:
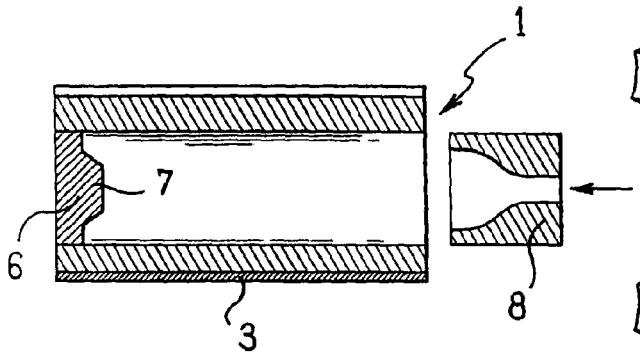
FIG. 3 is a section view on line III-III of FIG. 2.

With reference to FIG. 3, each cylindrical element 1 has an end wall 6 closing the open orifice 2. In practice, the cylindrical elements 1 are cut from a polyurethane section member, and the end walls 6, likewise made of polyurethane foam, are fitted to each of the cylindrical elements 1, e.g. by adhesive bonding or by welding. Each end 6 includes a centering portion 7 adapted to co-operate with the bottoms of wine bottles in order to stabilize them. A removable polyurethane foam plug 8 is used to close the open orifice. The plug 8 has an inside shape that matches the shape of the neck of a wine bottle. The polyurethane foam used advantageously forms thermal insulation, thereby enabling the bottles to be kept cool while they are being transported in the container.

Figure 6:
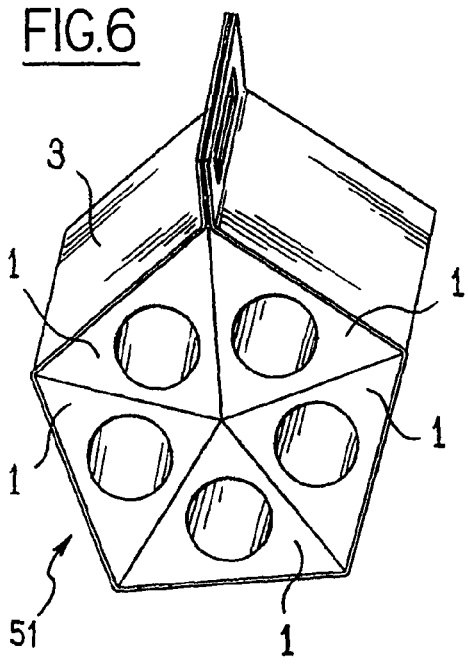
FIG. 6 is a perspective view of a container in accordance with the first embodiment, but having five cells.
Figure 7:
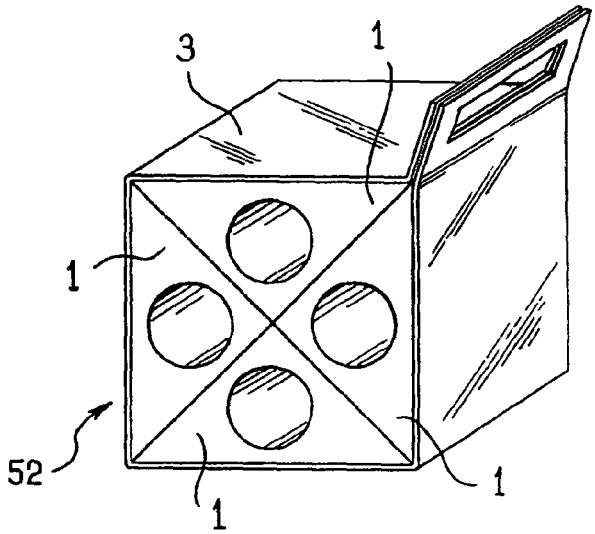
FIG. 7 is a perspective view of a container in accordance with the first embodiment, but having four cells.

Other variant embodiments could naturally be provided. The same principle can be used to make containers having a greater or smaller number of cylindrical elements. For example, it is possible to provide a folded container having eight cylindrical elements so that the container presents a cylindrical shape of octagonal section. In a variant shown in FIG. 6, the container 51 has five cylindrical elements so that it constitutes a cylindrical shape of pentagonal section when in the folded position. In another variant shown in FIG. 7, the container 52 has four cylindrical elements such that it takes on a cylindrical shape of square section when it is in the folded position.

Although the cylindrical elements are shown as being substantially triangular in section, it is possible to make use of cylindrical elements of other sections. For example, it is possible to provide cylindrical elements presenting a bottom wall that is rounded so that the container in the folded position presents a circular section.

Although the rounding of the apex in the cylindrical elements enables an extra bottle to be taken, such rounding is not essential. The cylindrical elements could be made with pointed apexes.

Although in the first embodiment the belt shown covers the bottom walls of the cylindrical elements completely, it is also possible to use a belt of smaller area, or indeed a loop of cord, a plastics strip, or the like, with the two strands thereof extending in parallel and being fastened to the bottom walls of the cylindrical elements, the two strands being joined together to form the handles.

Finally, although the hinge means between two adjacent cylindrical elements are constituted by belt portions, it is possible to use other hinge means. In particular, it is possible to provide cylindrical elements that are molded out of plastics material and that include hinge pins on one lateral edge and hinge sockets on the other so that the cylindrical elements can be hinged one to another.

Figure 8:
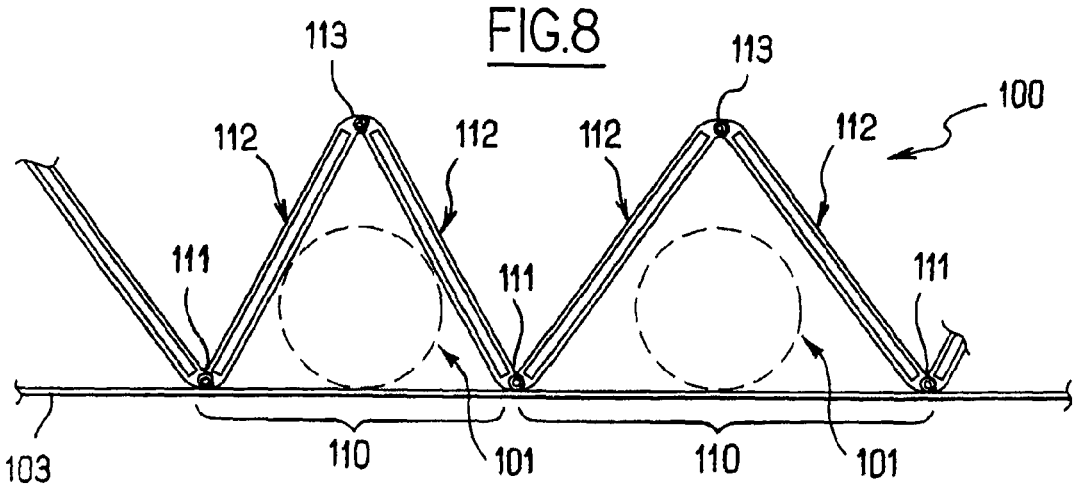
FIG. 8 is a fragmentary face view of a container in accordance with a second particular embodiment of the invention.
Figure 10:
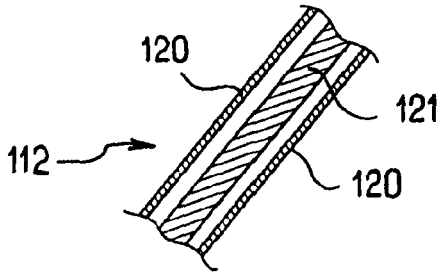
FIG. 10 is a fragmentary section view of a wall of one of the cells of the FIG. 8 container.
Figure 9:
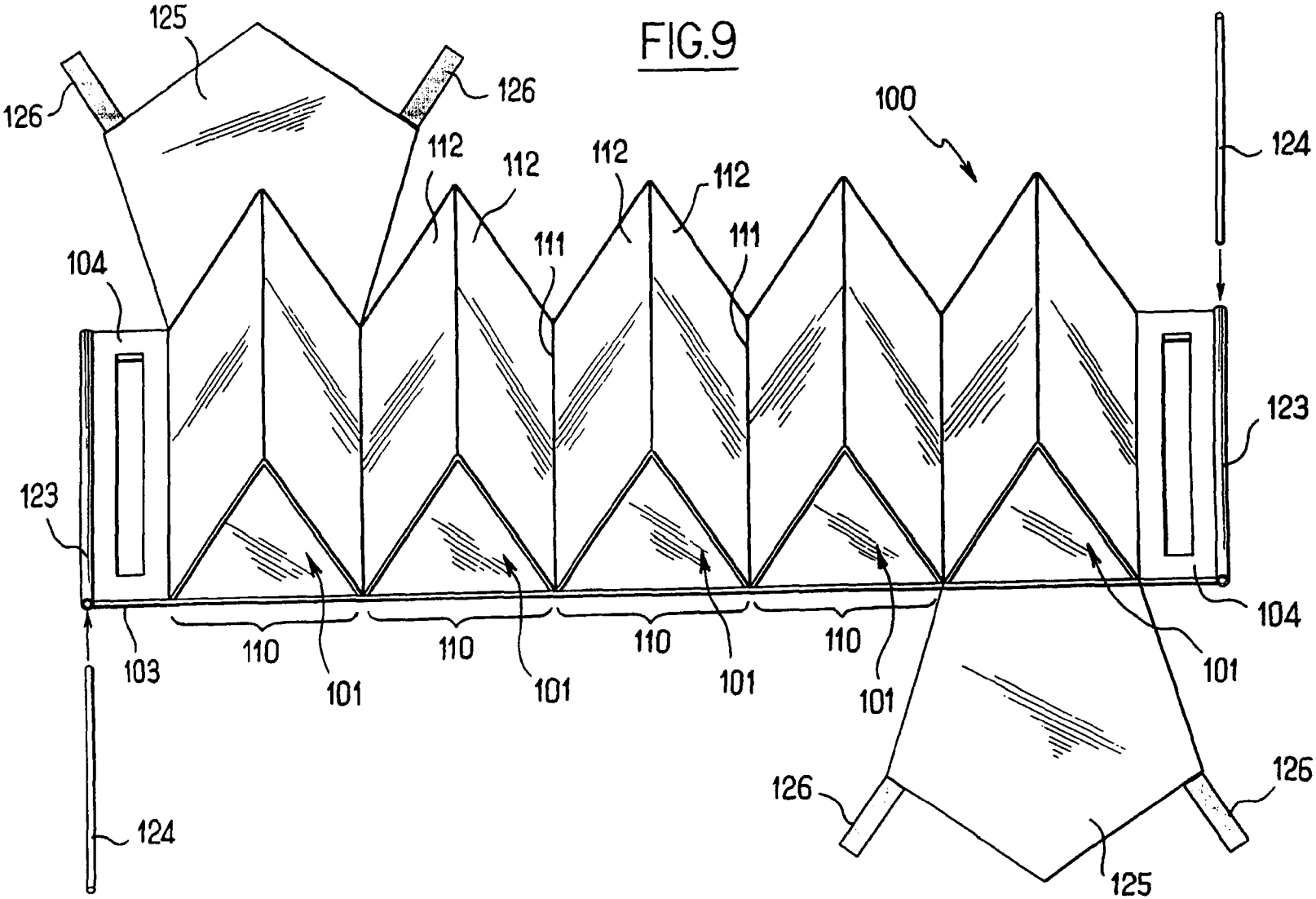
FIG. 9 is a perspective view of the FIG. 8 container.

In a second particular embodiment of the invention as shown in FIGS. 8 to 10, the cells of the container 100 comprise two converging side walls 112 that are hinged together at an apex 113. As can be seen in FIG. 10, each side wall 112 includes a pocket 120, made of transparent plastics material in the example, and having a thin rigid plate 121 of stiff cardboard of or plastics material inserted therein. The side walls 112 also have side edges 111 that are welded to a belt 103 of flexible plastics material. Thus, the portion of the belt 103 that extends between two side edges 112 forms a bottom wall 110 that, together with the two corresponding side walls 112 defines a hollow triangular cell 101 suitable for receiving a bottle.

Each cell 101 is thus hinged to the following cell via the side edge 111, and the side walls 112 present external side faces that come one against another when the container is in the folded position.

FIG. 9 shows a container 100 with five cells made on this principle. It should be observed that the side walls 112 are rigid while the bottom walls 110 are flexible. The belt 103 extends beyond the cells 101 to define two handles 104 with gussets 123 formed at the ends thereof in order to receive stiffeners 124.

Pentagonal closure walls 125 are provided on either side of the belt 103 to close the container when it is in the folded position. The closure walls 125 are provided with means 126 for holding them in the closed position, e.g. adhesive strips, or hook-and-loop fastener strips.

Naturally, a container made in accordance with the second particular embodiment can be subjected to numerous variants. For example, it is possible to use fabric instead of plastics material, the fabric itself possibly being welded or stitched at the apexes and also at the side edges. Instead of defining a side wall in the form of a pocket into which a rigid plate is inserted, it is possible to use rigid plates that are directly connected to one another, e.g. via hinges. It is also possible to use a long rigid plate that is folded accordion-like so as to define the apexes and the side edges.

Figure 11:
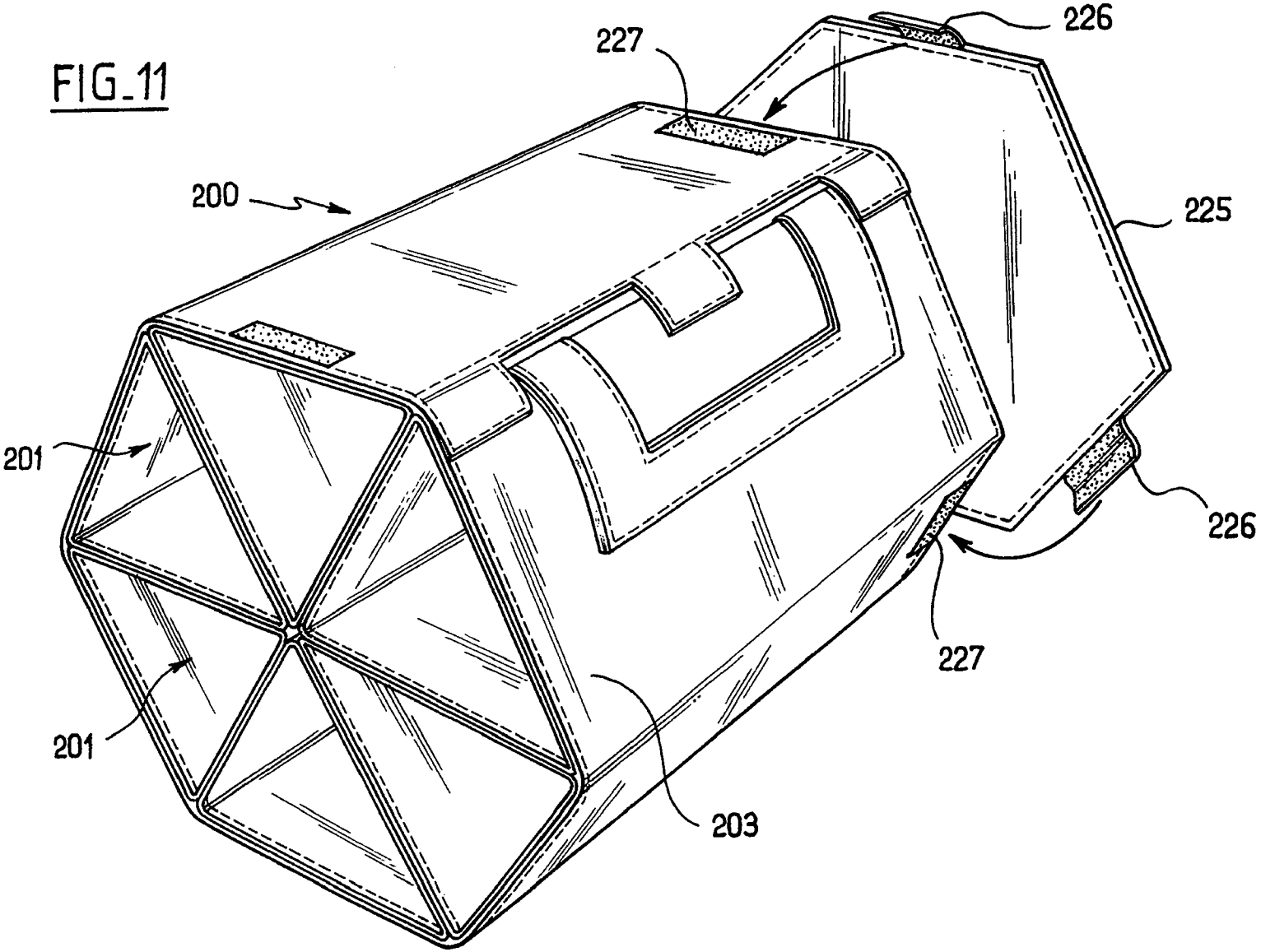
FIG. 11 is a perspective view of a container of the invention with separable closure walls.
Figure 12:
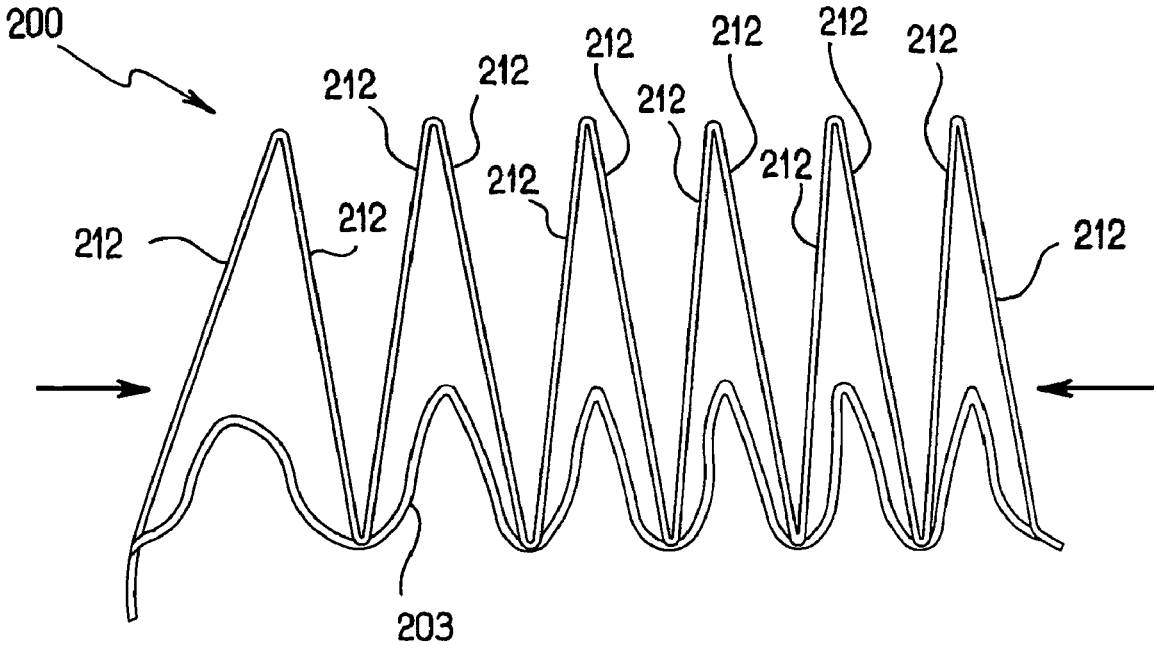
FIG. 12 is a face view of the FIG. 11 container shown while it is being folded for storage purposes.

In a variant shown in FIG. 11, the container 200 has hollow cells 201 similar to those of the container 100 of FIG. 9, but is modified so that the closure walls 225 are removable. The closure walls 225 are fitted onto the container when it is in the folded state by means of tabs 226 provided with hook-and-loop fastener means, such as those known under the trademark "Velcro", and adapted to co-operate with areas 227 fastened on the belt 203 (only one closure wall 225 is shown, for greater clarity). The container of FIG. 11, shown having six cells, is then capable, when empty, of being put into a storage configuration, as shown in FIG. 12. The rigid side walls 212 are folded, accordion-like, with the flexible belt 203 that forms the bottom walls of the cells deforming to take up position between the side walls. The volume occupied by the container is thus reduced to a minimum.

The invention claimed is:

1. A container for bottles or the like, wherein the container comprises a plurality of hollow cells each adapted to receive one bottle and presenting two converging external side faces and one bottom face with which the side faces define side edges;

wherein each of the cells is defined by two thin side walls that are interconnected at an apex, the side edges being connected to a belt in such a manner that the portion of the belt between two side edges forms a bottom wall of a triangular cell, the side walls defining the external side faces of the cell;

wherein the two side walls of a given cell are hinged together at the apex; and wherein the cells are interconnected so that two adjacent cells are hinged together via the side edges such that the container presents:

a folded state in which the side faces of the cells bear one against another so as to give the container the shape of a cylinder on a polygonal base; and a deployed state in which the bottom faces of the cells extend flat and the cells extend beside one another, with each of the cells remaining suitable for receiving one bottle.

2. The container according to claim 1, wherein the side walls of the cells are rigid, while the belt is flexible.

3. The container according to claim 2, including closure walls each adapted to close one of the ends of the container when it is in the folded position.

4. The container according to claim 3, wherein the closure walls are removable.

5. A container for bottles or the like, wherein the container comprises a plurality of hollow cells each adapted to receive one bottle and presenting two converging external side faces and one bottom face with which the side faces define side edges;

wherein each of the cells is defined by two thin side walls that are interconnected at an apex, the side edges being connected to a belt in such a manner that the portion of the belt between two side edges forms a bottom wall of a triangular cell, the side walls defining the external side faces of the cell;

wherein each side wall comprises a flexible pocket having a rigid plate inserted therein;

the cells being interconnected so that two adjacent cells are hinged together via the side edges such that the container presents:

a folded state in which the side faces of the cells bear one against another so as to give the container the shape of a cylinder on a polygonal base; and a deployed state in which the bottom faces of the cells extend flat and the cells extend beside one another, with each of the cells remaining suitable for receiving one bottle.

6. The container according to claim 5, wherein the side walls of the cells are rigid, while the belt is flexible.

7. The container according to claim 6, including closure walls each adapted to close one of the ends of the container when it is in the folded position.

8. The container according to claim 7, wherein the closure walls are removable.

* * * * *